US009371730B2

(12) United States Patent
Corre et al.

(10) Patent No.: US 9,371,730 B2
(45) Date of Patent: Jun. 21, 2016

(54) SYSTEM AND METHOD RELATED TO A SAMPLING PACKER

(75) Inventors: Pierre-Yves Corre, Eu (FR); Stephane Metayer, Abbeville (FR); Jean-Louis Pessin, Cailloux (FR); Kathiravane Tingat Cody, Le Ptessis-Robinson (FR); Alexander F. Zazovsky, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 511 days.

(21) Appl. No.: 13/880,613

(22) PCT Filed: Oct. 21, 2011

(86) PCT No.: PCT/US2011/057339

§ 371 (c)(1),
(2), (4) Date: Jul. 5, 2013

(87) PCT Pub. No.: WO2012/054865

PCT Pub. Date: Apr. 26, 2012

(65) Prior Publication Data

US 2014/0144625 A1 May 29, 2014

Related U.S. Application Data

(60) Provisional application No. 61/405,463, filed on Oct. 21, 2010.

(51) Int. Cl.

| | |
|---|---|
| ***E21B 49/10*** | (2006.01) |
| ***E21B 43/08*** | (2006.01) |
| ***E21B 33/127*** | (2006.01) |

(52) U.S. Cl.

CPC ..... *E21B 49/10* (2013.01); *E21B 33/127* (2013.01); *E21B 43/08* (2013.01)

(58) Field of Classification Search

CPC ... E21B 23/06; E21B 33/1208; E21B 33/127; E21B 33/1277; E21B 33/1285; E21B 43/08; E21B 49/10

See application file for complete search history.

(56) References Cited

U.S. PATENT DOCUMENTS

| | | | | |
|---|---|---|---|---|
| 5,549,159 | A | 8/1996 | Shwe et al. | |
| 2009/0159278 | A1 | 6/2009 | Corre et al. | |
| 2009/0308604 | A1 * | 12/2009 | Corre | E21B 49/084 166/250.17 |
| 2010/0071898 | A1 | 3/2010 | Corre et al. | |

OTHER PUBLICATIONS

International Search Report for PCT Application Serial No. PCT/US2011/057339 dated May 8, 2012.

* cited by examiner

*Primary Examiner* — Cathleen Hutchins
(74) *Attorney, Agent, or Firm* — Kenneth L. Kincaid

(57) ABSTRACT

A technique involves collecting formation fluids through a single packer. The single packer comprises an outer bladder with drains positioned in the outer bladder to obtain formation fluid samples. Features also may be incorporated into the single packer to limit sealing in the circumferential spaces between the drains and to provide a larger sampling surface than provided simply via the drain surface area.

20 Claims, 8 Drawing Sheets

SYSTEM AND METHOD RELATED TO A SAMPLING PACKER

RELATED APPLICATIONS

This application claims priority from U.S. Provisional Patent Application No. 61/405,463, filed on Oct. 21, 2010, entitled "Sampling Packer System."

BACKGROUND

Wells are generally drilled into the ground or ocean bed to recover natural deposits of oil and gas, as well as other desirable materials that are trapped in geological formations in the Earth's crust. A well is typically drilled using a drill bit attached to the lower end of a "drill string." Drilling fluid, or "mud," is typically pumped down through the drill string to the drill bit. The drilling fluid lubricates and cools the drill bit, and also carries drill cuttings back to the surface in the annulus between the drill string and the wellbore wall.

For successful oil and gas exploration, it is necessary to have information about the subsurface formations that are penetrated by a wellbore. For example, one aspect of standard formation evaluation relates to the measurements of the formation pressure and formation permeability. These measurements are important for predicting the production capacity and production lifetime of a subsurface formation.

One technique for measuring formation and reservoir fluid properties includes lowering a "wireline" tool into the well to measure formation properties. A wireline tool is a measurement tool that is suspended from a wireline in electrical communication with a control system disposed on the surface. The tool is lowered into a well so that it can measure formation properties at desired depths. A typical wireline tool may include one or more probes that may be pressed against the wellbore wall to establish fluid communication with the formation. This type of wireline tool is often called a "formation tester." Using the probe(s), a formation tester measures the pressure history of the formation fluids contacted while generating a pressure pulse, which may subsequently be used to determine the formation pressure and formation permeability. The formation tester tool also typically withdraws a sample of the formation fluid that is either subsequently transported to the surface for analysis or analyzed downhole.

In order to use any wireline tool, whether the tool be a resistivity, porosity or formation testing tool, the drill string must be removed from the well so that the tool can be lowered into the well. This is called a "trip". Further, the wireline tools must be lowered to the zone of interest, commonly at or near the bottom of the wellbore. The combination of removing the drill string and lowering the wireline tool downhole are time-consuming procedures and can take up to several hours, if not days, depending upon the depth of the wellbore. Because of the great expense and rig time required to "trip" the drill pipe and lower the wireline tools down the wellbore, wireline tools are generally used only when the information is absolutely needed or when the drill string is tripped for another reason, such as to change the drill bit or to set casing, etc. Examples of wireline formation testers are described, for example, in U.S. Pat. Nos. 3,934,468; 4,860,581; 4,893,505; 4,936,139; and 5,622,223.

To avoid or minimize the downtime associated with tripping the drill string, another technique for measuring formation properties has been developed in which tools and devices are positioned near the drill bit in a drilling system. Thus, formation measurements are made during the drilling process and the terminology generally used in the art is "MWD" (measurement-while-drilling) and "LWD" (logging-while-drilling).

MWD typically measures the drill bit trajectory as well as wellbore temperature and pressure, while LWD typically measures formation parameters or properties, such as resistivity, porosity, pressure and permeability, and sonic velocity, among others. Real-time data, such as the formation pressure, facilitates making decisions about drilling mud weight and composition, as well as decisions about drilling rate and weight-on-bit, during the drilling process. While LWD and MWD have different meanings to those of ordinary skill in the art, that distinction is not germane to this disclosure, and therefore this disclosure does not distinguish between the two terms.

Formation evaluation, whether during a wireline operation or while drilling, often requires that fluid from the formation be drawn into a downhole tool for testing and/or sampling. Various sampling devices, typically referred to as probes, are extended from the downhole tool to establish fluid communication with the formation surrounding the wellbore and to draw fluid into the downhole tool. A typical probe is a circular element extended from the downhole tool and positioned against the sidewall of the wellbore. Another device used to form a seal with the wellbore sidewall is referred to as a dual packer. With a dual packer, two elastomeric rings expand radially about the tool to isolate a portion of the wellbore therebetween. The rings form a seal with the wellbore wall and permit fluid to be drawn into the isolated portion of the wellbore and into an inlet in the downhole tool.

The mudcake lining the wellbore is often useful in assisting the probe and/or dual packers in making a seal with the wellbore wall. Once the seal is made, fluid from the formation is drawn into the downhole tool through an inlet by lowering the pressure in the downhole tool. Examples of probes and/or packers used in downhole tools are described in U.S. Pat. Nos. 6,301,959; 4,860,581; 4,936,139; 6,585,045; 6,609,568, and 6,964,301.

Reservoir evaluation can be performed on fluids drawn into the downhole tool while the tool remains downhole. Techniques currently exist for performing various measurements, pretests and/or sample collection of fluids that enter the downhole tool. However, it has been discovered that when the formation fluid passes into the downhole tool, various contaminants, such as wellbore fluids and/or drilling mud primarily in the form of mud filtrate from the "invaded zone" of the formation or through a leaky mudcake layer, may enter the tool with the formation fluids. The invaded zone is the portion of the formation radially beyond the mudcake layer lining the wellbore where mud filtrate has penetrated the formation leaving the (somewhat solid) mudcake layer behind. These mud filtrate contaminates may affect the quality of measurements and/or samples of formation fluids. Moreover, severe levels of contamination may cause costly delays in the wellbore operations by requiring additional time for obtaining test results and/or samples representative of formation fluid. Additionally, such problems may yield false results that are erroneous and/or unusable in field development work. Thus, it is desirable that the formation fluid entering into the downhole tool be sufficiently "clean" or "virgin". In other words, the formation fluid should have little or no contamination.

A variety of packers are used in wellbores for many types of applications, including fluid sampling applications. In some applications, a straddle packer is employed to isolate a specific region of the wellbore to allow collection of fluid samples. However, straddle packers use a dual packer configuration in which fluids are collected between two separate packers. The dual packer configuration is susceptible to mechanical stresses which limit the expansion ratio and the drawdown pressure differential that can be employed. Other applications rely on a single packer having sample drains positioned to collect well fluid for downhole analysis and/or storage in bottles for later analysis in a lab. The sample drains are bounded by guard drains which are used to collect well fluid in a manner that aids collection of a clean sample through the centrally located sample drains. However, existing designs may have certain limitations in specific sampling applications.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
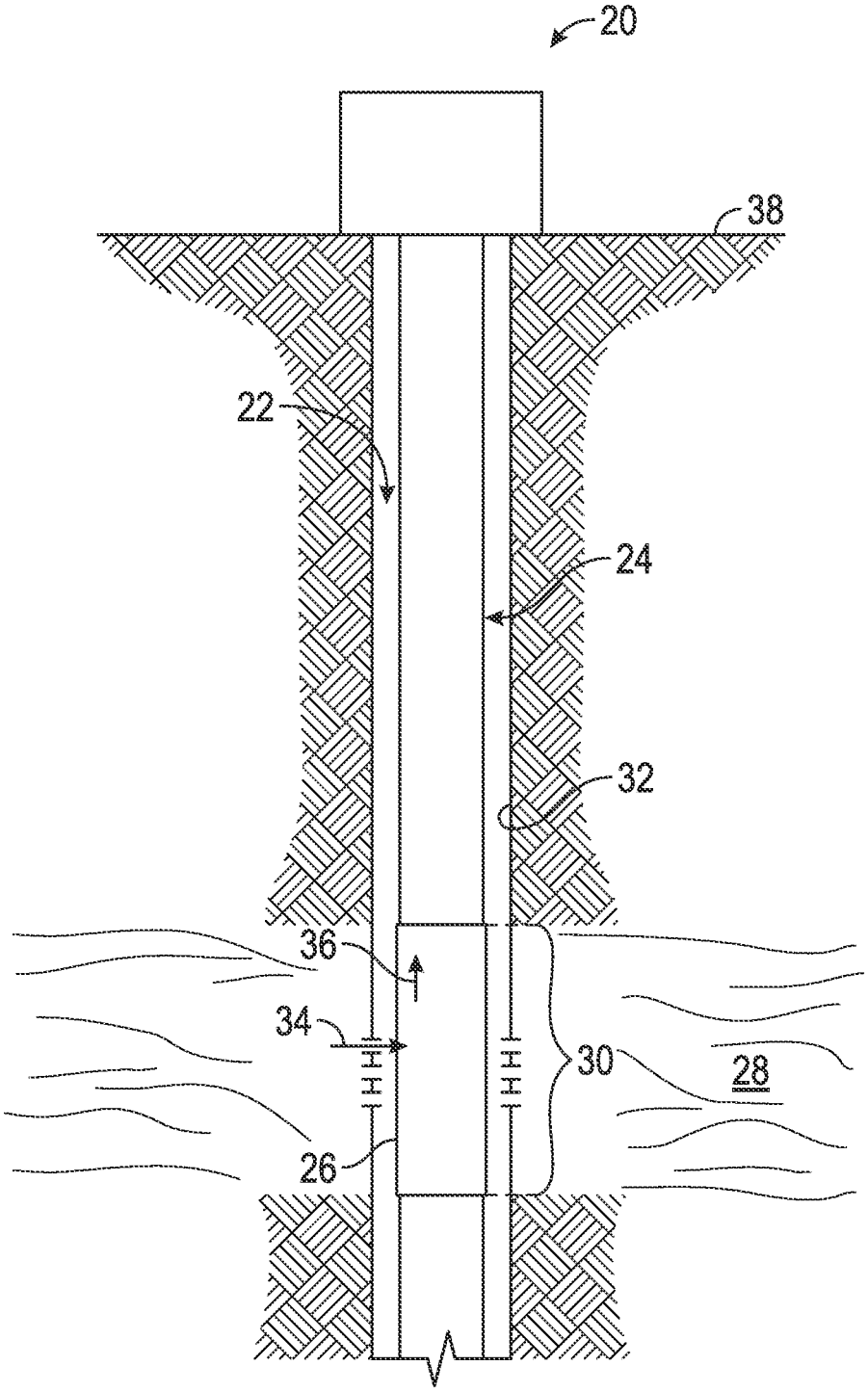
FIG. 1 is a schematic front elevation view of a well system having a single packer through which formation fluids can be collected.

In the following description, numerous details are set forth to provide an understanding of the present invention. However, it will be understood by those of ordinary skill in the art that the present invention may be practiced without these details and that numerous variations or modifications from the described embodiments may be possible.

The description herein generally relates to a system and method for collecting formation fluids through at least one drain located in a single packer. Formation fluid samples are collected through an outer layer of the single packer and transported or conveyed to a desired collection location. In embodiments described below, the single packer design enables creation of a substantially greater sampling surface and optimization of the sampling surface before and/or during an application. In some embodiments, features are incorporated to position a filter across a drain and/or to facilitate cleaning of filter screens through which well fluid is drawn during the sampling application.

During a sampling application, the single packer is expanded across an expansion zone. As the single packer is expanded, the outer layer of the single packer engages and seals against a well bore wall, a casing wall or other outer surface. A drain in the outer layer permits formation fluids to be collected from the expansion zone, i.e. between axial ends of an outer sealing layer. It should be understood by those having ordinary skill in the art that the single packer may be expanded or inflated by any known manner, such as inflated using fluid transported from the surface, inflated using wellbore fluid, inflated using fluid stored downhole, or expanded hydraulically or other means. The collected formation fluid is directed through flowlines, e.g. within flow tubes, having sufficient inner diameter to allow operations in a variety of environments. In an embodiment, separate drains can be disposed along the length of the packer to establish collection intervals or zones that enable focused sampling at a plurality of collecting intervals, e.g. two or three or more collecting intervals. Separate flowlines can be connected to different drains, e.g. sampling drains and guard drains.

According to an embodiment of the single packer, the packer is designed with a modular construction having separable components each of which may be readily replaced or interchanged. For example, the modular, single packer may comprise an outer bladder, an inner inflatable bladder, and mechanics mounted at the longitudinal ends of the outer bladder. The outer bladder may be expandable and comprise a resilient material, e.g. rubber, combined with flowlines, e.g. embedded flowlines, and drains, e.g. sample drains and guard drains. The flowlines and/or drains may be bonded to and/or embedded in the rubber material. The flowlines and/or drains may also be interchangeable such that they are removable and/or exchangeable without replacing the outer layer, inner bladder or other components of the single packer. The inner inflatable bladder may be inflated with fluid to enable selective expansion and contraction of the outer bladder. The mechanics may be arranged as mechanical ends connected to the flowlines of the outer bladder to collect and direct fluids intaken through the drains. If the single packer is formed as a modular packer, the components are readily changed without being forced to replace other components. For example, the outer bladder may be interchanged to promote adaptation to a given well environment. In another example, the surface production of the drains can be adapted by interchanging the outer bladder based on expected formation tightness or other formation parameters. In an embodiment, the drains are removably positioned in the outer bladder.

Referring generally to FIG. 1, an embodiment of a well system 20 is illustrated as deployed in a wellbore 22. The well system 20 comprises a conveyance 24 employed to deliver at least one packer 26 downhole. In many applications, the packer 26 is deployed by the conveyance 24 in the form of a wireline, but conveyance 24 may have other forms, including, but not limited to, a slickline, a data cable, a power cable, a mechanical cable, a drill string, a tubing string, drill pipe, and coiled tubing. The packer 26 may be connected to one or more tools (not shown) above or below the packer 26. For example, the packer 26 may be connected to a formation testing tool, a downhole fluid analysis tool or other tool capable of analyzing formation fluid downhole, storing formation fluid samples downhole, or transporting formation fluid samples.

Figure 2:
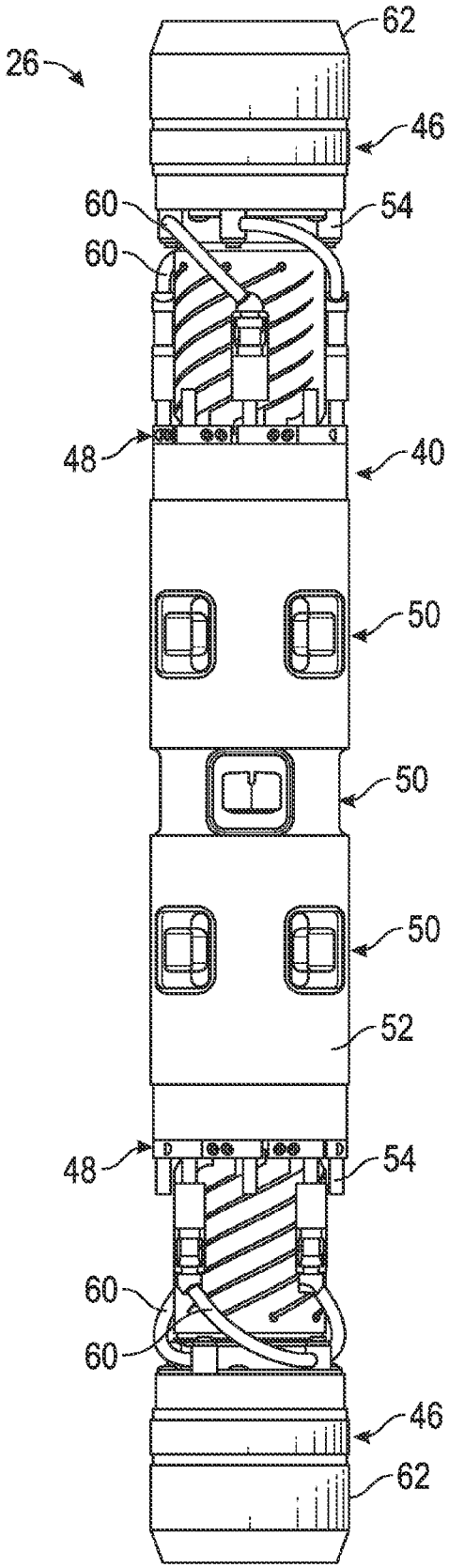
FIG. 2 is a front view of one example of the single packer illustrated in FIG. 1 in a modular configuration.
Figure 3:
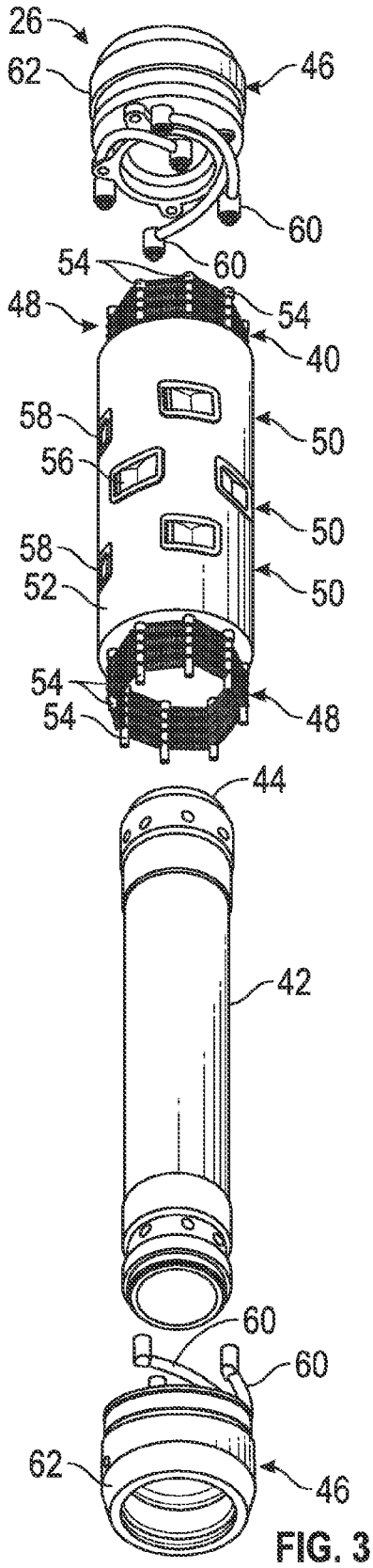
FIG. 3 is a view similar to that of FIG. 2 but showing at least some of the modular components in exploded form.

The single packer 26 is selectively expanded, inflated in a radially outward direction to seal across an expansion zone 30 with a surrounding wall 32, such as a surrounding casing or open wellbore wall. Referring generally to FIGS. 2 and 3, an example of the single packer 26 is illustrated. In this embodiment, the packer 26 comprises an outer bladder 40 which is expandable in a wellbore to form a seal with the surrounding wall 32 across expansion zone 30. The single packer 26 further comprises an inner, inflatable bladder 42 disposed within an interior of the outer bladder 40. The outer bladder 40 may comprise a plurality of layers, such as a seal layer 52 that contacts the surrounding wall 32, one or more anti-extrusion layers, one or more support layers and one or more other layers. By way of example, the seal layer 52 may be cylindrical and formed of an elastomeric material selected for hydrocarbon based applications, such as, but not limited to, nitrile rubber (NBR), hydrogenated nitrile butadiene rubber (HNBR), and fluorocarbon rubber (FKM). The one or more anti-extrusion layers (not shown) may comprise fibers, such as Kevlar or carbon fibers, an elastomeric sleeve, small diameter cables or any combination thereof. The one or more support layers may comprise metallic cables, fiber layers, rubber layers or combinations thereof. One of ordinary skill in the art will appreciate the various embodiments of the packer 26.

The inner bladder 42 is selectively expanded or inflated to move the outer bladder 40 into engagement with the surrounding wall. The inner bladder 42, for example, may be inflated by fluid delivered via an inner mandrel 44. The fluid may be stored downhole, may be delivered from the surface, or may be taken from the wellbore. For example, wellbore fluid, such as drilling fluid, may be transported or pumped into the inner bladder 42 to inflate the inner bladder 42. The inner bladder 42 expands or inflates to seal a portion of the wellbore 22, for example to provide a fluid and pressure seal above and below the expansion zone 30.

When the packer 26 is expanded to seal against the surrounding wall 32, formation fluids may flow into the packer 26, as indicated by arrows 34, as shown in FIG. 1. In the embodiment illustrated, the packer 26 is a single packer configuration used to collect formation fluids from a surrounding formation 28. The formation fluids are then directed to a flow line, as represented by arrows 36 in FIG. 1, and collected either downhole in the wellbore 22 and/or transported to a collection location, such as a location at a well site surface 38.

Figure 4:
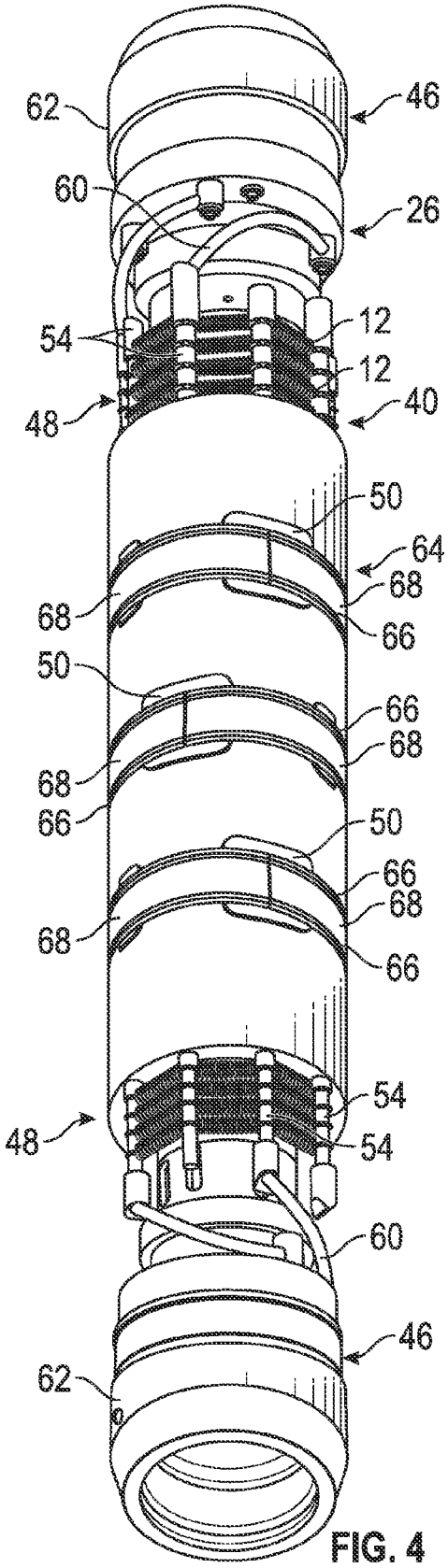
FIG. 4 is an orthogonal view of another example of the single packer but having a plate system which works in cooperation with the drains.

In the embodiment illustrated in FIG. 2, the outer bladder 40 comprises one or more drains 50 through which formation fluid is collected when outer bladder 40 is expanded to seal the single packer 26 against surrounding wellbore wall 32. Drains 50 may be embedded radially into (or removably mounted in) a sealing element or seal layer 52 of the outer bladder 40. As shown in FIGS. 2-4, the drains 50 may be positioned around the circumference of the packer 26. The drains 50 may be positioned at different axial positions and longitudinal positions. For example, a first plurality of the drains 50 may be positioned around a perimeter of the packer 25 at a first distance from an end of the packer 26, and a second plurality of the drains 50 may be positioned around a perimeter of the packer 25 at a second distance from an end of the packer 26. In such an example, the first plurality of the drains 50 may be at different axial and radial positions from the second plurality of the drains 50 such that the first plurality of the drains 50 are not aligned longitudinally with the second plurality of the drains 50, as shown in FIG. 2.

A plurality of flowlines, e.g. tubes, 54 may be operatively coupled with the drains 50 for directing the collected formation fluid in an axial direction, for example toward one or both of the mechanical ends 46. In one example, alternating flowlines 54 may be connected either to a central drain or drains, e.g. sampling drains 56, or to axially outer drains, e.g. guard drains 58, located on both axial sides of the middle sampling drains. The guard drains 58 may be located around the sampling drains 56 to achieve faster fluid cleaning during sampling. As further illustrated in FIG. 3, the flowlines 54 may be aligned generally axially along outer bladder 40. In some embodiments, the flowlines 54 are at least partially embedded in the material of the seal layer 52 and thus move radially outward and radially inward during expansion and contraction of the outer bladder 40. The guard drains 50 may be positioned closer to one of the ends of the packer 26 than the sampling drains 56. As a result the guard drains 50 may receive more mud filtrate or other contaminants or debris from the wall of the formation, than the sampling drains 56. In other words, the sampling drains 56 may receive clean, uncontaminated formation fluid prior to the guard drains 50. Accordingly, the packer 25 provides decreased sampling times as compared to traditional probes.

As shown in FIG. 4, a number of springs 12 may be positioned between the flowlines 54. The springs 12 may be biased to retract the packer 25 upon deflation or contraction of the packer 26. For example, the springs 12 may apply a force to aid in retracted or contracted the packer 26. The springs 12 may be any types of springs or devices capable of applying a force between the flowlines 54, such as tension springs. In the embodiment shown in FIG. 4, the springs 12 may be positioned between each of the flowlines 54. In addition, many of the springs 12 may be positioned between each of the flowlines 54, for example. The springs 12 may be positioned at each end of the flowlines 54 to aid in uniformly retracted or contracted the packer 26. In general as packers expand or inflate, it is difficult to retract the packers to their original size and shape. Advantageously, the springs 12 provide an improvement in refraction or contraction of the packer 26. The pressure inflating or expanding the packer 26 may be greater than the force of the springs 12, but upon a decrease in inflation or expansion pressure, such as when contraction or retraction is desired, then the springs 12 may apply a force between the flowlines 54 to aid in contracting the packer 26.

Furthermore, the packer 26 comprises mechanics, such as a pair of mechanical ends or fittings 46, which are engaged with axial ends 48 of outer bladder 40. Corresponding flowlines 60 of mechanical ends 46 engage the flowlines 54 when the mechanical ends 46 are mounted to longitudinal ends 48 of outer bladder 40. By way of example, each mechanical end 46 may comprise a collector portion 62 to which the corresponding flowlines 60 are pivotably mounted. By way of example, the flowlines 60 may be mounted for pivotable movement about an axis generally parallel with the longitudinal packer axis to facilitate pivoting motion during expansion and contraction of packer 26. Each collector portion 62 can be ported as desired to deliver fluid collected from the surrounding formation to a desired flow system for transfer to a collection location. The flowlines 60 enable the transfer of collected fluid from outer bladder flowlines 54 into the collector portion 62. A pump (not shown) may be connected to the flowlines 60 and/or the flowlines 54 to aid in removing formation fluid and transporting the formation fluid through the flowlines 54, 60. In an embodiment, each of the flowlines 54, 60 may be connected to a separate pump. In another embodiment, the flowlines 54, 60 may have a first pump (or first set of pumps) for the sampling drains 56 and a second pump (or second set of pumps) for the guard drains 58.

As illustrated in FIG. 3, the single packer 26 may be designed as a modular packer with interchangeable components. For example, the outer bladder 40 may be interchanged to promote adaptation to a given well environment. In another example, the surface production of the drains 50 can be adapted by interchanging the drains 50 or interchanging the outer bladder 40 based on expected formation tightness or other formation parameters.

Figure 5:
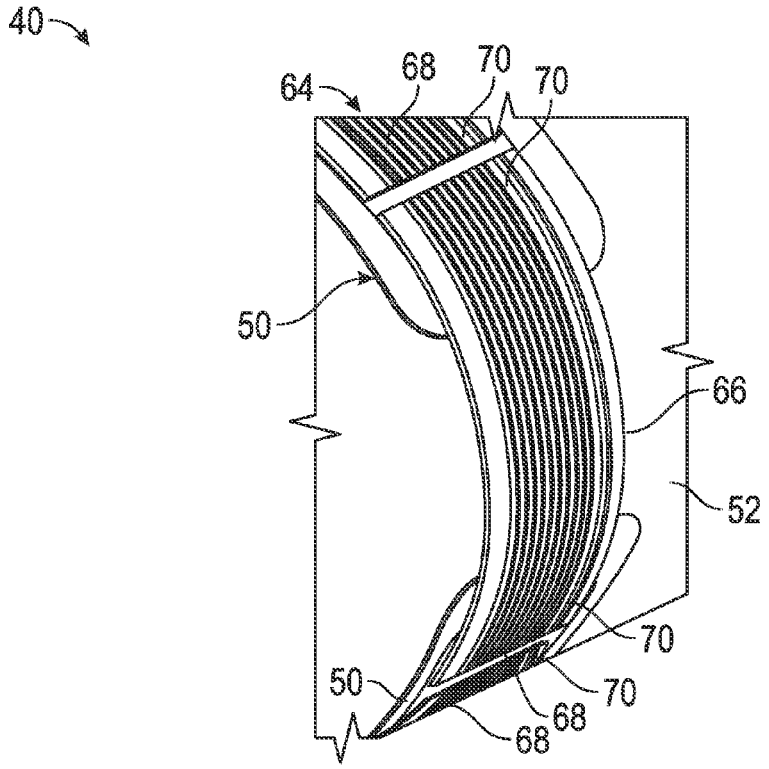
FIG. 5 is an orthogonal view of a portion of the single packer illustrated in FIG. 4 showing plates of the plate system closed over a drain.

In another embodiment, the single packer 26 comprises a plate system 64 which covers at least some of the drains 50 when the packer 26 is in a contracted state, as illustrated in FIGS. 4 and 5. In the contracted state, the plate system 64 may prevent fluid communication from the wellbore 22 at least some of the drains 50. The plate system 64 may be positioned between a first one of the drains 50 and a second one of the drains positioned about a circumference or perimeter of the packer 26. For example, the plate system 64 may be positioned to cover at least a portion of the circumferential spaces 66 between sequential drains 50 positioned circumferentially around the outer bladder 40. Covering the circumferential spaces 66 limits or prevents sealing in these regions located between circumferentially sequential drains 50, thereby providing a larger sampling surface than would otherwise be available when packer 26 is expanded against surrounding wall 32. In such an embodiment, fluid from the formation about the wellbore 22 may be permitted to flow into the circumferential spaces 66 and/or the sequential drains 50. In an embodiment, the plate system 64 may prevent the packer 26 from sealing between the sequential drains 50.

As further illustrated in FIG. 5, the plate system 64 may comprise a plurality of plates 68 with each plate 68 extending from one drain 50 to the next circumferentially adjacent drain 50. In the specific example illustrated, some plates 68 extend between sampling drains 56; and other plates 68 extend between axially outlying guard drains 58. The plates 68 may be designed with an appropriate curvature to generally match, for example have substantially similar shape and size, or at least cooperate with the curvature of the outer surface of outer bladder 40. Additionally, plates 68 may be formed from a hard material relative to the compliant sealing material of seal layer 52. In at least one embodiment, the plates 68 are formed from a metallic material, such as a steel material or other suitable metal material. In an embodiment, the plates 68 are formed from a high performance plastic or thermoplastic material. If the plates 68 extend the complete distance between circumferentially adjacent drains 50, the plates 68 act to prevent any sealing in the circumferential spaces 66 extending from each drain 50 to the next circumferentially adjacent drain 50.

Figure 6:
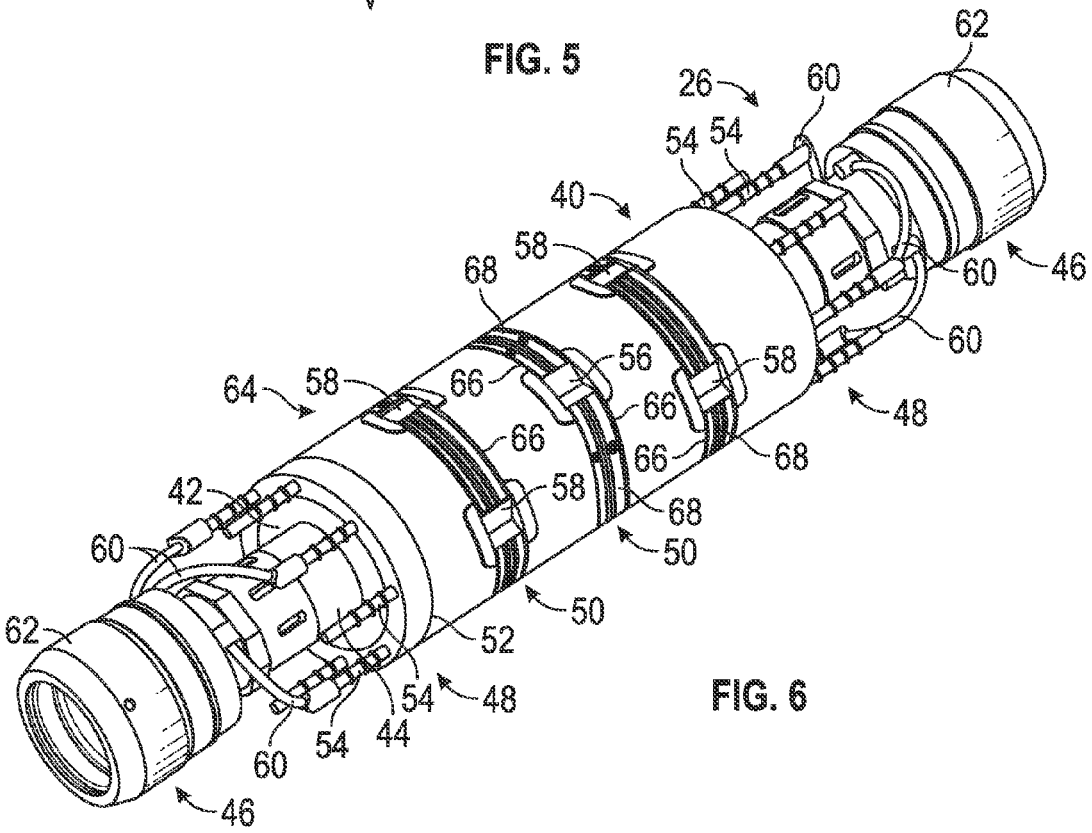
FIG. 6 is an orthogonal view of the single packer illustrated in FIG. 4 but in an expanded state.

When the single packer 26 is expanded by inflating inner bladder 42, the increasing diameter of outer bladder 40 spreads the plates 68. The spreading of plates 68 causes ends 70 of plates 68 to move apart circumferentially and expose the drains 50, as illustrated in FIGS. 5 and 6, to permit fluid communication with the wellbore 22. The drains 50 move away from the ends 70 of the plates 68 as the packer 26 expands or inflates. When the packer 26 is fully expanded, plate ends 70 are pulled to the side edges of the drain 50 to enable free flow of well fluid through the drains 50. By way of example, the plate ends 70 may be appropriately bent to engage the corresponding edges of drains 50 when single packer 26 is transitioned from the contracted state to the fully expanded state. However, the present disclosure should not be deemed as limited to bent plate ends as other embodiments of plate ends 70 are possible.

Figure 7:
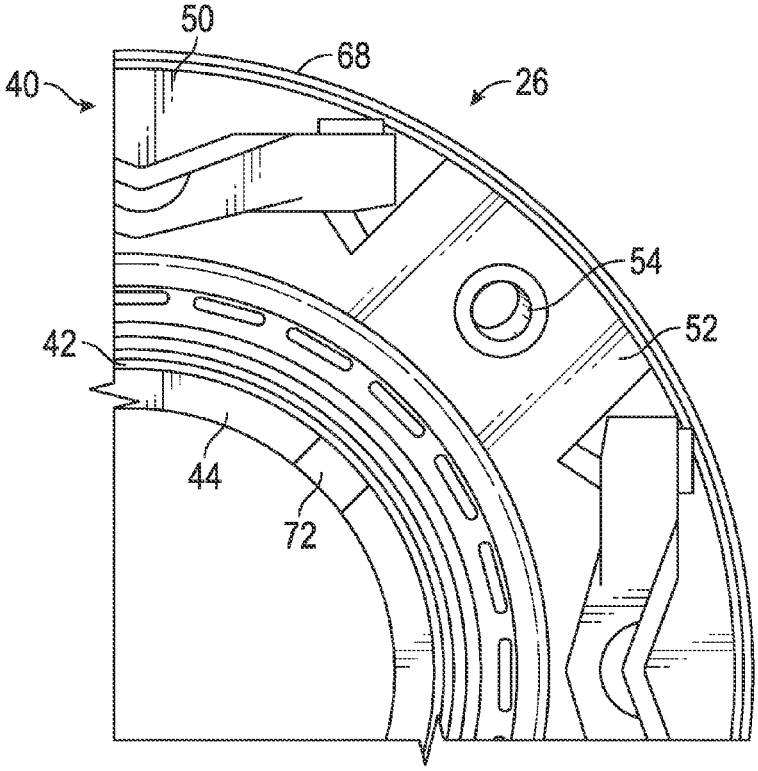
FIG. 7 is a cross-sectional view of a portion of the single packer illustrated in FIG. 4 with the plates in a closed position while the single packer is in a contracted state.
Figure 8:
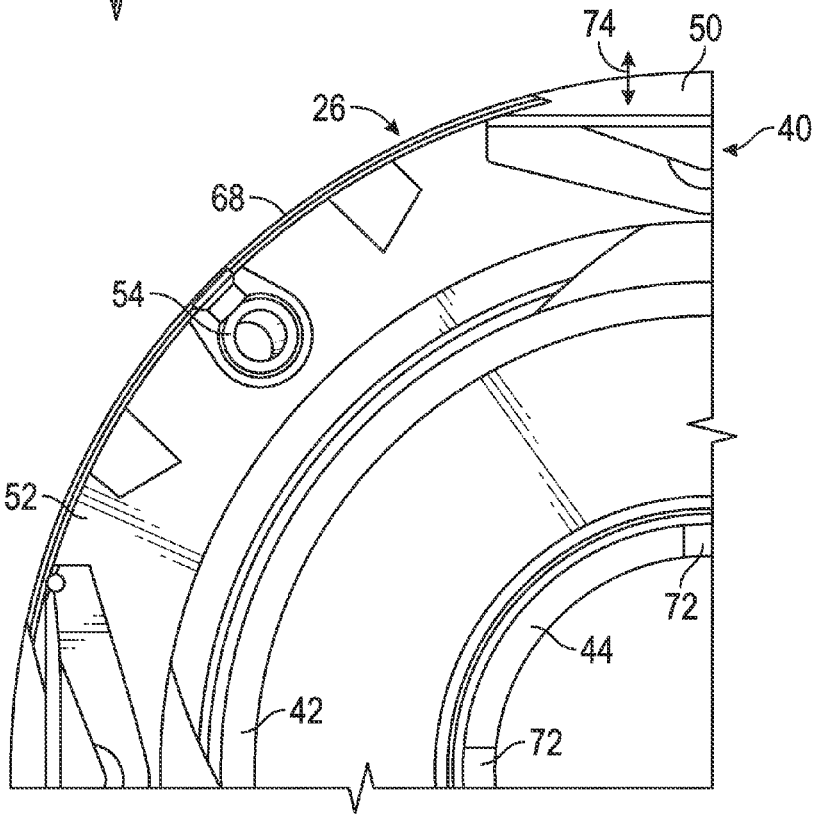
FIG. 8 is a cross-sectional view of a portion of the single packer illustrated in FIG. 4 with the plates in an open position while the single packer is in an expanded state.

Referring generally to FIGS. 7 and 8, partial cross-sectional views are provided to better illustrate the movement of plates 68 as the packer 26 is transitioned from a contracted position (see FIG. 7) to an expanded position (see FIG. 8). In the embodiment illustrated in FIG. 7, the metal plates 68 are formed as curved, metallic slats which extend over and cover the corresponding drains 50, e.g. sampling drains 56, while the packer is in a contracted position. (The contracted state is employed during, for example, movement through wellbore 22 including conveyance downhole into the wellbore.) However, when pressurized fluid is delivered through the internal mandrel 44 and into the inner inflatable bladder 42 via mandrel holes 72, the outer bladder 40 is expanded. The inflation of the inner bladder 42 expands the outer bladder 40 which transitions the packer 26 to its expanded state illustrated in FIG. 8. Expansion of the outer bladder 40 causes plates 68 to pull away from the corresponding drains 50, or the drains 50 to move away from the plates 68 to enable free flow of fluid through the drain, as represented by arrow 74.

Figure 9:
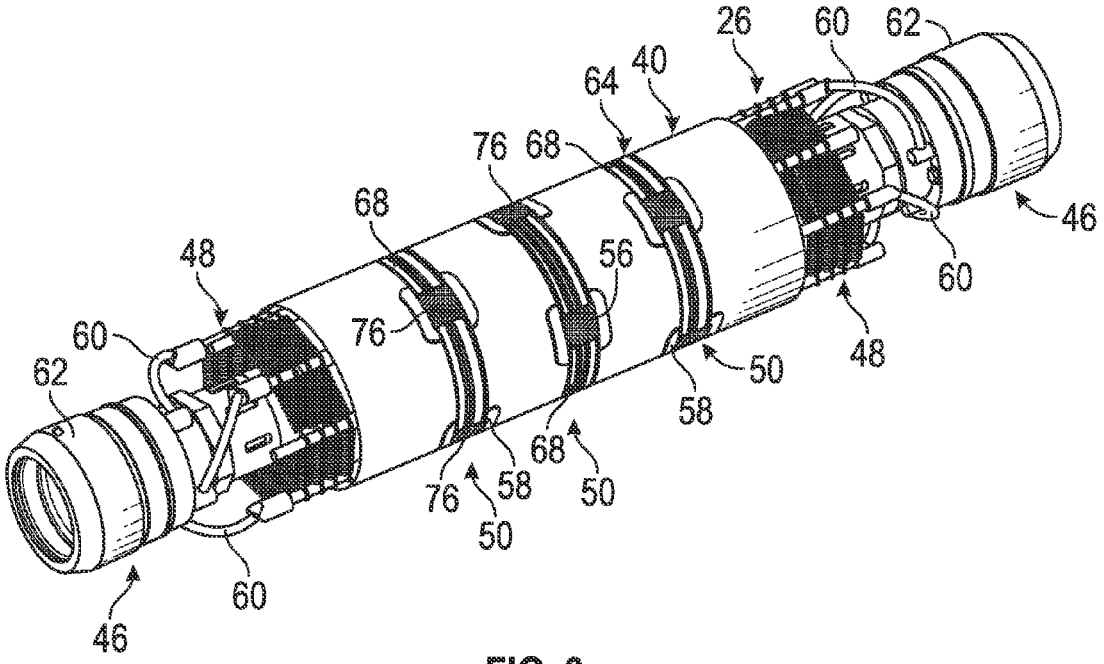
FIG. 9 is an orthogonal view of another example of the single packer with filter screens positioned in at least some of the drains.
Figure 10:
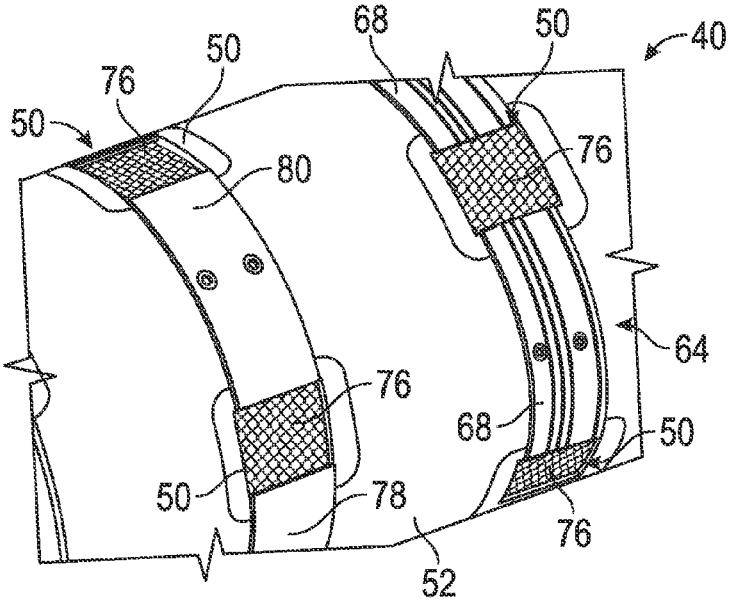
FIG. 10 is an orthogonal view of a portion of the single packer illustrated in FIG. 9 showing the filter screens in combination with plates of the plate system.

Another embodiment of the single packer 26 is illustrated in FIGS. 9 and 10. In this embodiment, one or more of the drains 50 may have a filter 76, e.g. filter screens, designed to remove particulates from the well fluid before the well fluid passes through the drains 50. In the example illustrated, the filter 76 is positioned in or one or more of the sampling drains 56 and the guard drains 58. However, the filters 76 may be placed on individual or selected drains, e.g. on the sampling drains 56 or alternatively on the guard drains 58. Additionally, the filters 76 may be formed from mesh materials, wire mesh screens, and a variety of other filter materials. The filter 76 may be removable and replaceable without replacing the outer bladder 40 and/or without replacing the drains 50, such as the sampling drains 56 and/or the guard drains 58.

Figure 11:
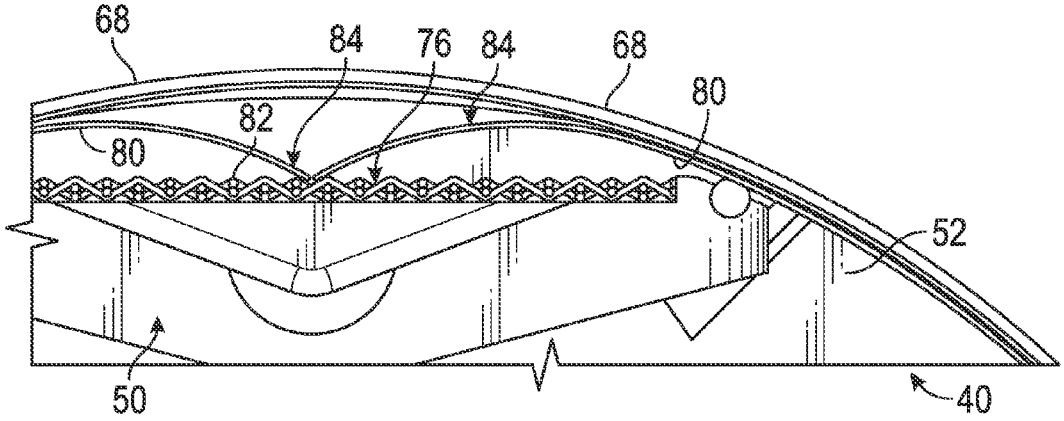
FIG. 11 is a cross-sectional view of a portion of another example of the single packer in which scrapers are employed to clean the filter screen.
Figure 12:
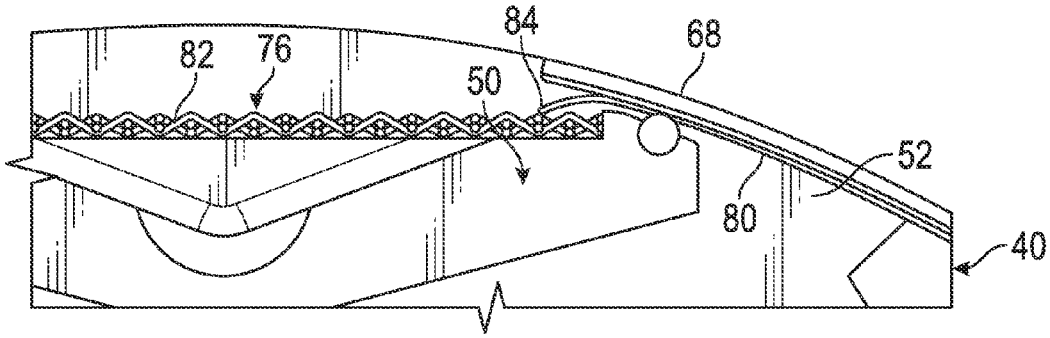
FIG. 12 is a view similar to that of FIG. 11 but showing the scrapers and the plates shifted to an open position due to expansion of the single packer.

To prevent clogging and/or to remove debris from the filters 76, the outer bladder 40 may incorporate features to clean the filters 76 during expansion and/or contraction of the single packer 26. For example, the plates 68 may incorporate and/or work in cooperation with a cleaning feature 78 designed to scrape or otherwise remove accumulated matter or debris from the filter 76 to ensure flow of fluid through the drains 50. As illustrated in FIGS. 10-12, for example, each plate 68 may comprise a scrapper 80 positioned to remove debris and/or other matter from the filter 76. The scrapper 80 may move across the filter 76 as the filter 76 is exposed to the formation fluid. For example, as the packer 26 is expanded or contracted, the scrapper 80 moves across the filter 76 to move debris or other matter away from the filter 76. Movement of the scrapper 80 over the filter 76 forces accumulated debris away from the filter 76 and opens the drain for better flow.

Referring generally to FIGS. 11 and 12, an example of the scrapper 80 is illustrated for use in cleaning debris away from filters 76. In this example, the filter 76 is in the form of a filter screen 82, e.g. a mesh filter screen, and the cleaning features 78 comprise the scrapper 80 which may be biased to a move over the filter 76 when the packer 26 contracts. Each of the scrappers 80 may comprise curved biased ends serving as engaging members 84. The engaging members 84 flex downwardly into biased contact with the filter screen 82. This allows the engaging member 84 to scrape along and clean the filter screen 82 as the packer 26 is transitioned from a contracted state (see FIG. 11) to an expanded state (see FIG. 12) or vice versa. Each scrapper 80 may be positioned at a radially underlying position relative to the corresponding plate 68.

In some embodiments, each of the scrappers 80 is secured to its corresponding plate 68 by an appropriate fastener, adhesive, or other suitable affixation method. Also, both the plate 68 and the scrapper 80 may be secured to the outer bladder 40 by, for example, an appropriate adhesive or fastener used to secure the plate 68 against the seal layer 52. It should be noted that a cleaning feature 78 may be in the form of the scrapper 80 or a variety of other mechanisms designed to interact with the corresponding filters 76. By way of example, the cleaning feature 78 may be in the form of curved tips extending from plates 68, wires, brushes, or other mechanisms designed to remove debris from the drain filter 76.

Figure 13:
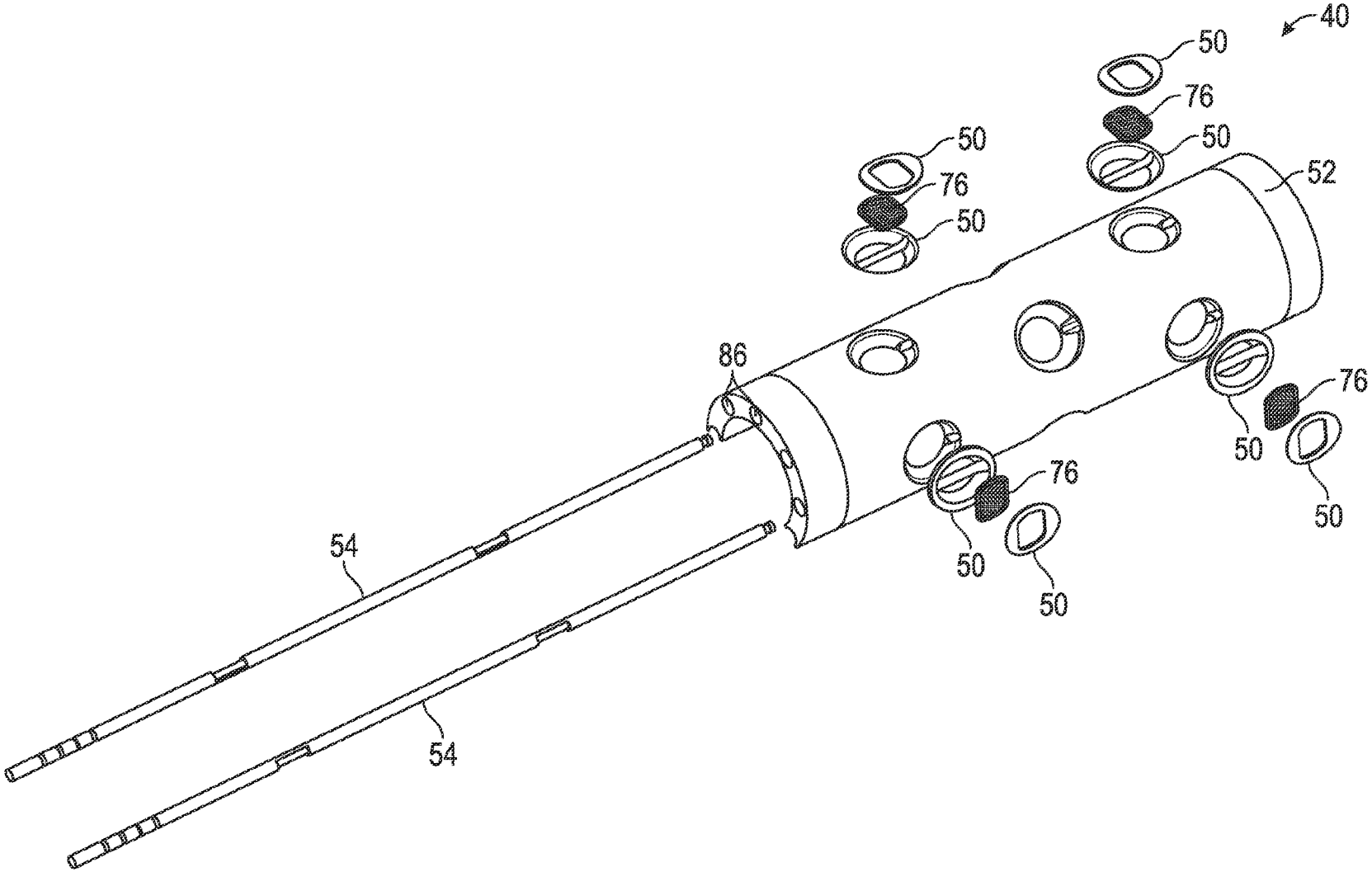
FIG. 13 is an exploded view of an alternate example of an outer bladder of the single packer in which the drains and flow lines are interchangeable.

In another embodiment of the single packer 26, the outer bladder 40 is formed as a modular unit whereby the drains 50 and/or the flow lines 54 are interchangeable, as illustrated in FIG. 13. In this embodiment, the modularity of the packer 26 is expanded further which enables a variety of repairs and adjustments to be made without replacing the entire outer bladder 40. For example, the pressure differential rating of the packer 26 may be optimized according to specific well conditions to allow maximum flow performance by selecting and interchanging appropriate flowlines 54 and drains 50. The costs associated with the outer bladder 40 also may be decreased by allowing adjustment of the outer bladder 40 to meet specific conditions and by enabling repair of the outer bladder through replacement of components.

In the embodiment illustrated in FIG. 13, the flowlines 54, the drains 50, and the filters 76 are removable to enable interchanging with other components and/or replacement of the components. In one example, the flowlines 54 may be individually inserted into wall tubes 86 which are bonded to the seal layer 52 of the outer bladder 40. The wall tubes 86 are located within corresponding openings or passages formed longitudinally through the outer bladder 40. The wall tubes 86 may be designed as light weight/thin walled tubes. The wall tubes 86 may be positioned away from contact with well fluid and are protected from pressure differentials by, for example, having fluid flow through flowlines 54. Consequently, the wall tubes 86 may be formed from a variety of materials optimized for bonding with the seal layer 52 and need not be formed of stainless steel or other strong, corrosion resistant materials. If operation of the packer 26 is conducted in extremely harsh environments, the wall tubes 86 may be manufactured from appropriate, corrosion resistant materials, including stainless steels or nickel-cobalt alloys, e.g. MP35N nickel cobalt alloy.

As described above, well system 20 may be constructed in a variety of configurations for use in many environments and applications. The single packer 26 may be constructed from several types of materials and components for collection of formation fluids from single or multiple intervals within a single expansion zone. Furthermore, single packer 26 may be formed as a modular unit to enable replacement of components and/or interchanging of components with other components suited for specific well conditions. The modularity also may include creating the outer bladder 40 as a modular unit with interchangeable components.

Additionally, an increase in sampling surface area may be accomplished with the plates 68 or other types of features used to form the plate system 64. The plate system 64 may be constructed from metal materials, hard plastic or high performance plastic materials, composite materials, or other suitable materials that prevent or limit sealing engagement with a surrounding wellbore wall 32. The plate system 64 also may incorporate or work in cooperation with a variety of cleaning features 78, e.g. scrapers 80, designed to remove debris from regions of the sampling drains 56 and/or guard drains 58. The cleaning features 78 are selected to work with specific types of filters 76 employed in the drains 50 to filter debris, e.g. particulates, from the well fluid flowing through the drains 50. Furthermore, the actual size, configuration and materials used to form the outer bladder 40, the inner bladder 42, and mechanics may vary from one application to another. Similarly, the fasteners and bonding techniques for connecting the various components may be selected as appropriate for the given environments and operational conditions of a specific sampling application.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for collecting fluid from a specific region of a wellbore, comprising:

a packer comprising:

an outer bladder expandable in a wellbore across an expansion zone to contact and fluidly separate a first portion of the wellbore from a second portion of the wellbore, wherein the outer bladder having a plurality of drains for receiving formation fluid into the packer, and wherein the plurality of drains comprises a first drain and a second drain both spaced around a circumference of the packer;

an inflatable bladder disposed within the outer bladder; and a plate positioned along the circumference between the first drain and the second drain of the plurality of drains to limit sealing in the circumferential space between the first drain and the second drain.

2. The system as recited in claim 1, wherein the plurality of drains comprise a third drain positioned at a different axial and radial position from the first drain and the second drain, the third drain positioned closer to an end of the packer than the first drain and the second drain.

3. The system as recited in claim 1, wherein the plate extends over the first drain if the single packer is in a contracted state and exposes the first drains if the single packer is in an expanded state.

4. The system as recited in claim 3, wherein the plate has a length defined by a first end opposite a second end, the first end adjacent the first drain and the second end adjacent the second drain, and further wherein the first drain moves away from the first end as the packer expands to expose the first drain.

5. The system as recited in claim 1, wherein the plate prevents any fluid seal between the first drain and the second drain.

6. The system as recited in claim 1, wherein the plate has a substantially similar shape as the circumferential space between the first drain and the second drain.

7. The system as recited in claim 1 further comprising a filter positioned over the first drain or the second drain to limit debris or other matter having a predetermined size from passing through the filter.

8. The system as recited in claim 7 wherein the filter is a mesh screen attached to the outer layer of the packer.

9. The system as recited in claim 7 further comprising a scraper to move debris or the other matter away from the filter.

10. The system as recited in claim 9 wherein the scraper is a member attached to the plate and bent toward the filter such that movement across the filter moves debris away from the filter.

11. A method, comprising:

providing a single expandable packer having an outer bladder;

positioning a plurality of sample drains in the outer bladder; and connecting the plurality of sample drains to a plurality of flowlines capable of transporting formation fluid from the plurality of sample drains to a collection location; and positioning a spring between a first flowline and a second flowline of the plurality of flowlines, the spring applying a force to retract the packer as the packer deflates or contracts.

12. The method as recited in claim 11 wherein the spring is a tension spring.

13. The method as recited in claim 11 further comprising a plurality of springs, at least one spring of each of the plurality of springs positioned between each of the plurality of flowlines to apply a force to retract the packer as the packer deflates or contracts.

14. The method as recited in claim 11 wherein the plurality of drains comprises a first plurality of drains at a first axial distance from an end of the packer and a second plurality of drains at a second axial distance from an end of the packer, the first distance greater than the second distance.

15. The method as recited in claim 11 further comprising positioning a plate between a circumferential space between a first drain and a second drain of the plurality of drains, wherein the plate prevents sealing between the first drain and the second drain.

16. The method as recited in claim 15, wherein the plate extends over the first drain if the single packer is in a contracted position and exposes the first drain to fluid from a wellbore if the single packer is in an expanded position.

17. A packer for use in a wellbore comprising:

an outer bladder expandable in a wellbore across an expansion zone to contact and fluidly separate a first portion of the wellbore from a second portion of the wellbore, wherein the outer bladder having a plurality of drains for receiving formation fluid into the packer;

an inflatable bladder disposed within the outer bladder;

a filter positioned on at least one of the plurality of drains, the filter having openings limiting size of debris that passes through the filter; and a scraper to move debris or the other matter away from the filter.

18. The packer as recited in claim 17 wherein the plurality of drains are interchangeable or replaceable without replacing or changing the outer bladder.

19. The packer as recited in claim 17 further comprising flowlines connected to the plurality of drains, wherein the flowlines are interchangeable or replaceable without replacing or changing the outer bladder.

20. The packer as recited in claim 17 wherein the filter is a wire mesh filter secured to the outer bladder.

* * * * *